US011199387B2

(12) United States Patent
Choiniere et al.

(10) Patent No.: US 11,199,387 B2
(45) Date of Patent: Dec. 14, 2021

(54) ACCURATE RANGE-TO-GO FOR COMMAND DETONATION

(71) Applicant: BAE SYSTEMS Information and Electronic Systems Integration Inc., Nashua, NH (US)

(72) Inventors: Michael J. Choiniere, Merrimack, NH (US); Bruce Winker, Weaverville, NC (US)

(73) Assignee: BAE Systems Information and Electronic Systems Integration Inc., Nashua, NH (US)

( * ) Notice: Subject to any disclaimer, the term of this patent is extended or adjusted under 35 U.S.C. 154(b) by 591 days.

(21) Appl. No.: 16/123,269

(22) Filed: Sep. 6, 2018

(65) Prior Publication Data

US 2020/0080824 A1 Mar. 12, 2020

(51) Int. Cl.

| | |
|---|---|
| ***F42B 15/01*** | (2006.01) |
| ***F42C 13/04*** | (2006.01) |
| ***F41G 7/30*** | (2006.01) |
| ***F41G 7/22*** | (2006.01) |

(52) U.S. Cl.

CPC ..... *F42B 15/01* (2013.01); *F41G 7/2286* (2013.01); *F41G 7/30* (2013.01); *F42C 13/04* (2013.01)

(58) Field of Classification Search

None

See application file for complete search history.

(56) References Cited

U.S. PATENT DOCUMENTS

| | | | | |
|---|---|---|---|---|
| 4,539,514 | A * | 9/1985 | Espelage | H02P 1/30 318/713 |
| 7,533,849 | B2 | 5/2009 | Zemany et al. | |
| 7,999,212 | B1 | 8/2011 | Thiesen et al. | |
| 8,450,668 | B2 | 5/2013 | Maynard et al. | |
| 9,683,814 | B2 | 6/2017 | Dryer | |
| 9,709,372 | B2 * | 7/2017 | Edwards | F41G 7/30 |

OTHER PUBLICATIONS

Tae-Hun, New Guidance Filter Structure for Homing Missiles withStrapdown HR Seeker, International Journal of Aeronautical and Space Sciences. Dec. 2017. 18(4): 757-766 (Year: 2017).*

* cited by examiner

*Primary Examiner* — Hovhannes Baghdasaryan

(74) *Attorney, Agent, or Firm* — KPIP Law, PLLC; Scott J. Asmus

(57) ABSTRACT

The system and method for accurately determining range-to-go for the command detonation of a projectile. Using dual laser and/or radio frequency detectors on the tail and on the nose of a spinning projectile to determine the range-to-go, time-to-go, or lateral offset from the projectile to the target.

18 Claims, 6 Drawing Sheets

ACCURATE RANGE-TO-GO FOR COMMAND DETONATION

FIELD OF THE DISCLOSURE

The present disclosure relates to guided munitions and more particularly to a system and method for accurately determining range-to-go for command detonation of a projectile by measuring theta-dot relative to an incoming threat.

BACKGROUND OF THE DISCLOSURE

Precise command detonation maximizes the warhead effects against a target and is highly depended on the "range to go" or "time to go" prior or after impact. Depending on the target and warhead fragment pattern there is an optimum distance in front of the target for soft target (UAS, aircraft, combatants, etc.). For structures, a distance "after" the target, or a delayed detonation, may be useful when flight through a window is preferred, for example. In either case, knowing the time accurately has been difficult. Many simple rounds have used spin counters and by knowing the target range and the number of revolutions/meter from the projectile rifling, one can program the round to detonate after a particular spin count. However, these and other techniques rely on knowing the range to extreme accuracy prior to launch and are totally ineffective for moving targets. What is typically lacking is an architecture that measures the "time-to-go" to the actual target and thereby improves accuracy.

Wherefore it is an object of the present disclosure to overcome the above-mentioned shortcomings and drawbacks associated with conventional guided munitions.

SUMMARY OF THE DISCLOSURE

One aspect of the present disclosure is a method for controlling a projectile warhead, comprising: providing a projectile comprising a tail portion and a nose portion; detecting a first laser signal via a detector mounted on the tail portion of the projectile; determining a first time at which the first laser signal is detected via the detector mounted on the tail portion of the projectile; detecting a second laser signal via a detector mounted on the nose portion of the projectile, the second laser signal being the first laser signal that has reflected off a target; determining a second time at which the second laser signal is detected via the detector mounted on the nose portion of the projectile; comparing the first time to the second time to determine a time delay; determining a lateral offset between the projectile and the target using the time delay between detection by the first detector and detection by the second detector; and determining an angle, theta, using the lateral offset and the time delay between detection by the first detector and detection by the second detector to accurately control detonation of the projectile based on the fragmentation pattern for the projectile.

One embodiment of the method for controlling a projectile warhead is wherein the detector on the tail of the projectile is an electro-optical PIN diode. Another embodiment of the method for controlling a projectile warhead is wherein the detector on the nose of the projectile is an array PIN diode.

In certain embodiments of the method for controlling a projectile warhead, a range finding clock is started when the first signal is detected ($T_{zero}$) by the detector on the tail of the projectile and the range finding clock is stopped when the second signal is detected by the detector on the nose of the projectile ($T_{reflected}$), thereby creating a time differential that represents a round trip time between the projectile and the target which can be converted to a range-to-go. In some cases, when the time-to-go is time about 0.005 seconds, a signal is sent to the projectile to cause the projectile to detonate. In some cases, the time-to-go determination is dependent on the projectile speed and the detonation time-to-go is programmed at the time of launch. In yet another embodiment, the time-to-go value is negative.

In certain embodiments, the first signal further comprises a first pulse repetition interval and the second signal further comprises a second pulse repetition interval. In some cases, the lateral offset between the projectile's trajectory and the target's actual position is determined by measuring a time expansion between the first pulse repetition interval and the second pulse repetition interval and convolving the projectile's velocity with the time-to-go thereby improving an accuracy of a detonation.

In another embodiment of the method for controlling a projectile warhead, the method further comprising calculating theta dot and/or theta double dot. In some cases, the theta dot (the first derivative with respect to time—angular velocity) or theta double dot (the second derivative with respect to time—angular acceleration) is used without the range-to-go calculation to determine the optimum detonating distance using a Kalman filter.

Another aspect of the present disclosure is a method for controlling a projectile warhead, comprising: providing a projectile comprising a tail portion and a nose portion; detecting a first RF signal via a detector mounted on the tail portion of the projectile; determining a first time at which the first RF signal is detected via the detector mounted on the tail portion of the projectile; detecting a second RF signal via a detector mounted on the nose portion of the projectile, the second RF signal being the first RF signal that has reflected off a target; determining a second time at which the second RF signal is detected via the detector mounted on the nose portion of the projectile; comparing the first time to the second time to determine a time delay; determining a lateral offset between the projectile and the target using the time delay between detection by the first detector and detection by the second detector; and determining an angle, theta, using the lateral offset and the time delay between detection by the first detector and detection by the second detector to accurately control detonation of the projectile based on the fragmentation pattern for the projectile.

One embodiment of the method for controlling a projectile warhead is wherein the detector on the tail and/or the nose of the projectile is a radio frequency antenna.

Another embodiment of the method for controlling a projectile warhead is wherein a range finding clock is started when the first signal is detected ($T_{zero}$) by the detector on the tail of the projectile and the range finding clock is stopped when the second signal is detected by the detector on the nose of the projectile ($T_{reflected}$), thereby creating a time differential that represents a round trip time between the projectile and the target which can be converted to a range-to-go.

In some cases, when the time-to-go is time about 0.005 seconds, a signal is sent to the projectile to cause the projectile to detonate. In some cases, the time-to-go determination is dependent on the projectile speed and the detonation time-to-go is programmed at the time of launch. In another embodiment of the method for controlling a projectile warhead, the time-to-go value is negative.

In yet another embodiment of the method for controlling a projectile warhead, the first signal further comprises a first pulse repetition interval and the second signal further comprises a second pulse repetition interval and the lateral offset between the projectile's trajectory and the target's actual position is determined by measuring a time expansion between the first pulse repetition interval and the second pulse repetition interval and convolving the projectile's velocity with the time-to-go thereby improving an accuracy of a detonation.

In still yet another embodiment of the method for controlling a projectile warhead, the method further comprises calculating theta dot and/or theta double dot, wherein the theta dot (the first derivative with respect to time—angular velocity) or theta double dot (the second derivative with respect to time—angular acceleration) is used without the range-to-go calculation to determine the optimum detonating distance using a Kalman filter.

Yet another aspect of the present disclosure is a guided munition, comprising; a tail sensor located on a tail portion of the guided munition for detecting a laser beam; a forward sensor located on a forward portion of the guided munition and detecting a reflected signal from a target; a computer readable storage device having instructions, which when executed by a processor, cause the processor to execute: determining a first time at which the laser beam is detected via the tail detector; determining a second time at which the reflected signal is detected via the front detector; comparing the first time to the second time to determine a time delay; determining a lateral offset between the guided munition and the target using the time delay; determining a detonation start time when the guided munition is approximately perpendicular to the target; and determining the detonation time using the lateral offset and the time delay.

These aspects of the disclosure are not meant to be exclusive and other features, aspects, and advantages of the present disclosure will be readily apparent to those of ordinary skill in the art when read in conjunction with the following description, appended claims, and accompanying drawings.

BRIEF DESCRIPTION OF THE DRAWINGS

The foregoing and other objects, features, and advantages of the disclosure will be apparent from the following description of particular embodiments of the disclosure, as illustrated in the accompanying drawings in which like reference characters refer to the same parts throughout the different views. The drawings are not necessarily to scale, emphasis instead being placed upon illustrating the principles of the disclosure.

DETAILED DESCRIPTION OF THE DISCLOSURE

Figure 1A:
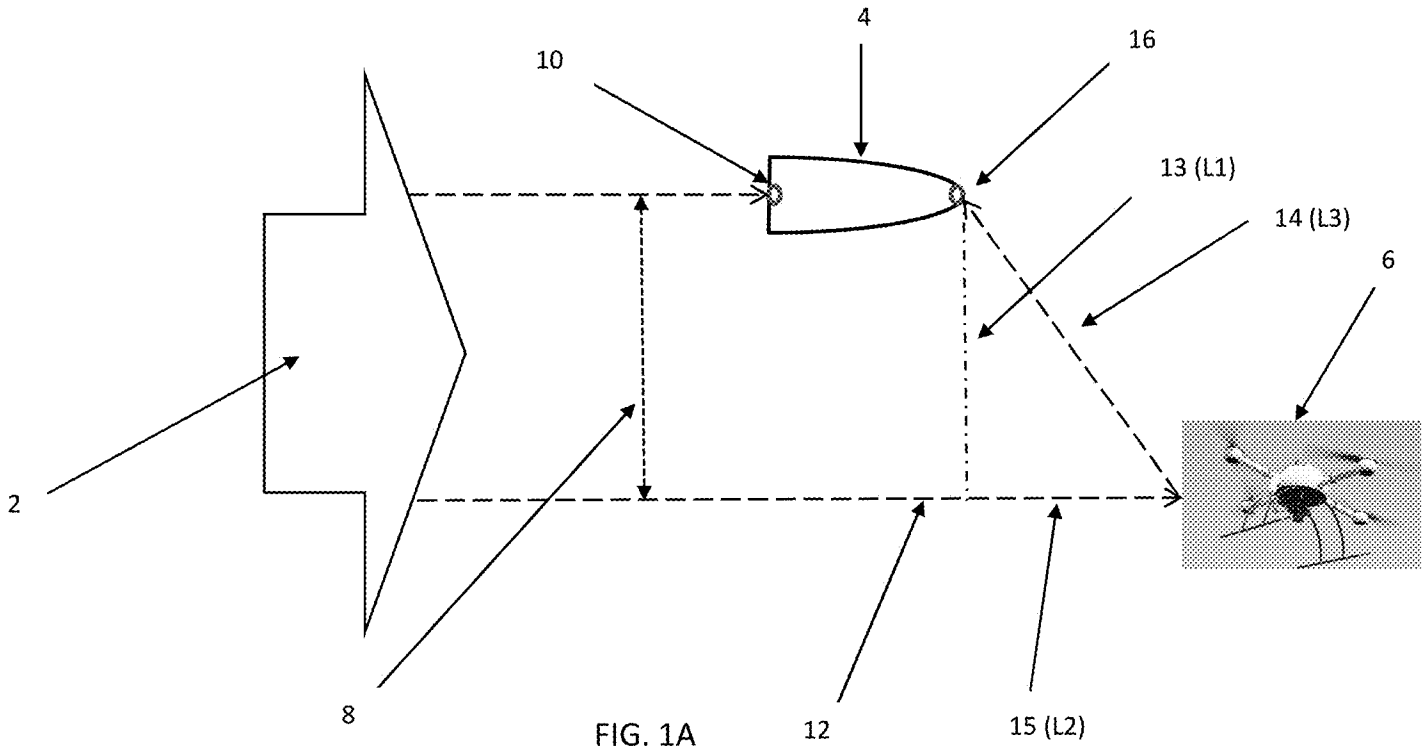
FIG. 1A shows one embodiment of the system of the present disclosure.

One embodiment of the present disclosure is a system for accurately determining the range-to-target distance for a guided munition. In one embodiment, the accuracy is within less than a meter. In some cases, the system utilizes a low energy, short pulse laser (e.g., fiber laser) or radio frequency pulse to paint a target. The short pulse can be 1 to 50 nanoseconds depending on the transmitter. In some cases, the system is low power since the path is one way from the illuminator to the projectile. In certain embodiments, low energy is about 100 μJoules per pulse.

In certain embodiments, munitions are laser guided. There, a target is illuminated, or "painted," by a laser target designator on the ground or on an aircraft. One disadvantage of laser guided munitions is in poor weather the system may not be useable because the target illumination cannot be seen, or if the target designator cannot get near the target. In certain embodiments, a laser designator sends a beam in a coded series of pulses so the munition will identify the proper signals, and that way multiple designators can operate in the same region.

In certain embodiments, the munitions are guided with radio control. In some cases, an aircraft transmits control signals to the munition to guide it to the target. In some cases, the RF or laser signal emanates from a plane or vehicle weapons fire control system. The fire control system guides the weapon to the target using the RF, electro-optical (EO), or a combination of the two modalities and illuminates the target during the terminal end game or region near the target.

In certain embodiments, the target may be large and fixed, but in other embodiments the target may be a small, moving target or something in between. In one embodiment, the target is an unmanned vehicle, such as a drone. In one embodiment, the target is vehicle, such as an air or land vehicle. In one embodiment, the target is building.

In certain embodiments of the system of the present disclosure, a spinning projectile, or munition, is guided to the target from a tracking station. In some cases, a tracking station may be on the ground, such as part of command and control. In some cases, the tracking station may be on a vehicle. In certain embodiments, the munition is guided by a fire control system on the launch platform.

In some cases, the munition is spinning at 0.5-2 k revolutions/second. In some cases, the munition is a fly-by projectile that has a directional blast pattern that necessitates accurate detonation in order to hit the target with the maximum number of fragments while mitigating unintended hits or misses. In some embodiments, the blast pattern may be about 1-20 m wide.

In certain embodiments, the fiber laser, or the like, is used to emit radiation to paint the target and/or to track the munition. In some cases, the emitted radiation is used to provide an azimuth (Az) and an elevation (El) bearing for the projectile relative to the target. In some cases, the radiation will hit the back of the projectile and reflect back to the tracking station, or the like. In some cases, the tracking station reports only the Az and El position for the projectile, thus simplifying the electro-optical (EO)/radio frequency (RF) system used in the present command detonation system.

One aspect of the present disclosure is a system comprising a radio frequency (RF) or laser short energy pulse (10 to 100 ns) that illuminates a projectile's rear sensor and one or more targets. The energy of the short energy pulse is reflected off the target and is received by a second sensor on the nose of the projectile. The first sensor detects the pulse energy as it passes by the projectile, generating a $T_{zero}$ (i.e., the start of a range finding clock). The clock is stopped when the target's reflected energy is detected by the second sensor at $T_{reflected}$. The time differential represents the round trip time between the projectile and the target which can be converted to a range.

In one embodiment of the system of the present disclosure, the system uses the measured RF or laser energy detection from sensor 1 and 2 in a simple limit trip switch approach. When the time-to-go is time <0.010 seconds, or the like, the projectile will detonate. In certain embodiments, the time is dependent on the projectile speed, warhead ideal detonation distance, and other factors. The "time-to-go" could be a time variable programmed at launch and/or could be negative (e.g., when flying through a window).

Another embodiment of the present disclosure determines the lateral offset between the projectile's trajectory and the target's actual position (i.e., a lateral miss distance). In this embodiment, the projectile's rear sensor(s) can determine the projectile's velocity by measuring the time increase between each pulse interval. The time base of each illumination pulse or the pulse repetition interval (PRI) serves as means to measure the time expansion between pulse intervals. If the projectile was not moving, the PRI would match the expected PRI. For a 40 Hz system, the PRI is 25 milliseconds, a projectile at MACH 3 would travel 25 meters. The 25 meters→81 feet→81 nanosecond (speed of light) increases the PRI time base which can be measured and tracked. By convolving the velocity with the "time-to-go and θ measurement," one can determine the lateral offset, thereby improving/optimizing the accuracy of the detonation.

One aspect of the present disclosure is a method of determining the optimum time detonation of a-to-go and the measured angle (θ) of the target's flight path vector. In one embodiment of the system of the present disclosure, the system is comprised of laser/RF illuminator that paints both the projectile and the target, a EO/IR or RF detector on the rear of the projectile generating a time zero pulse, a front looking EC/IR detector array or antenna array which measures the laser's/RF illuminator round trip time from projectile to target and back. In some cases, the forward-facing detector is a small array (e.g. 10 by 10 pixels). In some cases, the forward-facing detector is a larger array (e.g., 200 by 200 pixels). By knowing the round trip time and the angle of arrival, an optimum time for the denotation of a munition can be determined.

In another embodiment of the method, the theta (θ), the measured angle of the target's flight path vector can be used without range-to-go calculation to determine the optimum detonating distance. In yet another embodiment of the method, the theta dot (i.e., the first derivative with respect to time—angular velocity) or theta double dot (i.e., the second derivative with respect to time—angular acceleration) can be used without the range-to-go calculation to determine the optimum detonating distance using a Kalman filter.

Kalman filtering is also known as linear quadratic estimation (LQE). It is an algorithm that uses a series of measurements observed over time, containing statistical noise and other inaccuracies, and produces estimates of unknown variables that tend to be more accurate than those based on a single measurement alone, by estimating a joint probability distribution over the variables for each time-frame. The algorithm works in a two-step process. In the prediction step, the Kalman filter produces estimates of the current state variables, along with their uncertainties. Once the outcome of the next measurement (necessarily corrupted with some amount of error, including random noise) is observed, the estimates are updated using a weighted average, with more weight being given to estimates with higher certainty. The algorithm is recursive. Kalman filtering can run in real time, using only the present input measurements and the previously calculated state and its uncertainty matrix; no additional past information is required.

High damage percentage detonations need to ensure the target is within a damage zone by measuring the actual offset angle to the projectile relative to the threat. This approach measures that angle. One embodiment of the present disclosure is placing a pin diode on the rear of the projectile and an array on the projectile's forward surface, or nose. By painting the target with a low power, short pulse laser (e.g., a fiber laser), the rear facing detector generates the time zero and the laser return off the projectile generates the range-to-go and angle between the projectile's centerline and the threat. Between the range-to-go (hypotenuse) and the theta (θ) angle the position of the projectile relative to the threat can be determined. By using theta and/or range, the optimum command detonation time can be realized.

In some cases, the rear facing detector/antenna generates a time zero ($T_{zero}$) and as well as Az and El information for the projectile. In certain embodiments, a laser return off the projectile, which is detected by the detector on the face of the projectile, generates the range-to-go to the target. This method eliminates the need to determine the range at the tracking station, thus reducing the cost of the scanner and the peak power of the laser or RADAR used to paint the target.

In some cases, the system also eliminates the complex latency of the tracking system since the projectile acts as its own reference. By using the same laser or radio output, and mounting a pair of receivers on the munition, the losses are reduced from $R^4$ and approach $R^2$ losses. In a traditional system where the fire control system uses RADAR or LIDAR to track the projectile and the target, the losses are in terms or range$^4$ or $R^4$. The energy goes out to both target and projectile generating $R^2$ losses in the outgoing and then the return energy; thereby producing $R^4$ losses. The one path ($R^2$) could reduce the power need from megawatts to kilowatts or reduce the power needed by the square root of the power needed for a RADAR or LIDAR. This assumes first order and neglects environmental losses.

Since unmanned aircraft are very small, LIDAR and RADAR are ineffective at generating range-to-go for a projectile to the target due to the small signatures of the targets. By tracking them with EO sensors at the fire control system, the azimuth (Az) and elevation (El) of the target can be determined. There, range remains difficult given the weak return signal. The projectile can still be launched and guided to the target using a version of line of sight (LOS) command guidance. As the projectile approaches the target, the weak signal goes from $R^4$ at the beginning of the flight to $R^2$ prior to target contact. Even a weak signal is detected with the system of the present disclosure since the receiver in now on the projectile.

Referring to FIG. 1A, one embodiment of the disclosure is shown. More specifically, a laser pulse and/or an RF pulse 2 is propagated in the direction of a target 6 and a munition 4. The laser pulse and/or RF pulse is used to determine the Az and El of the projectile by detecting reflected signals with sensors located on the projectile. The trajectory error 8 associated with the Az and El data is determined by a Fire Control EO/RF subsystem. In some cases, the Fire Control subsystem is located on the projectile's launch platform. In certain embodiments, a detector mounted on the rear of the projectile 10 detects the laser pulse and/or RF pulse and establishes a time zero ($T_{zero}$). In some cases, the laser pulse and/or RF pulse is reflected off the target 14 and is detected by a nose-mounted detector 16 on the munition/projectile. In some cases, the forward-facing detector is an array PIN diode.

Still referring to FIG. 1A, determining the time delay between the detection of the radiation signal at the back of the munition with a detector proximate the tail portion 10 and the detection of the reflected radiation signal off the target by the detector on the front portion 16, allows a range-to-go to be calculated. This approach also allows the projectile 4 to know its lateral offset from the target. In some embodiments, the lateral offset is determined by the Fire Control system and the time-to-go is determined from the laser/RF pulse. By using the time delay calculated from the differential path 12, an accurate detonation time can be set. In other words, a first signal is detected by the detector mounted on the tail of projectile 10 and a second signal is detected by the detector located on the front of the projectile 16 as the signal is reflected back from the target. The front portion 16 refers to the nose cone or any location forward of the tail portion such as a mid-body location.

Figure 1B:
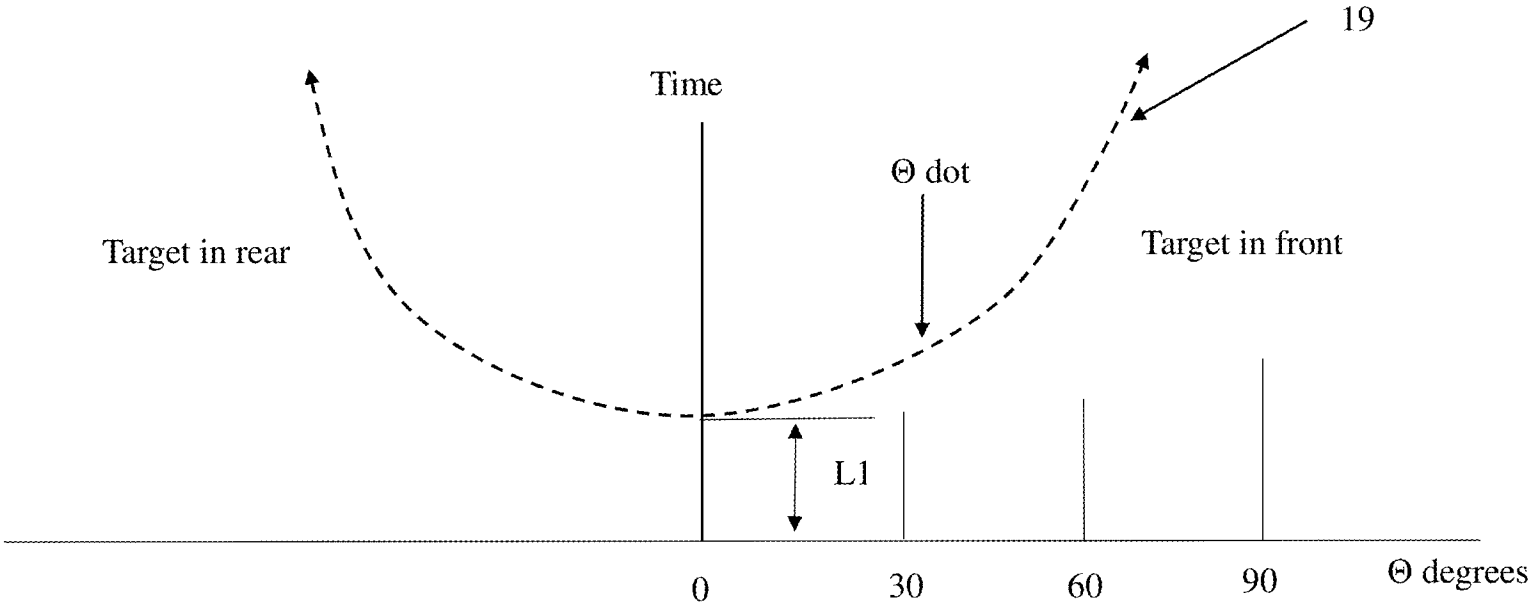
FIG. 1B shows calculations for range-to-go, lateral offset, and the like according to the principles of the present disclosure.

Referring to FIG. 1B, the calculations for range-to-go, lateral offset, and the like according to the principles of the present disclosure are shown. More specifically, a plot of theta, θ, against time is shown. The lateral offset L1 is shown. There is it possible to see that as the projectile (e.g. munition) flies over the target, the distance and thus the time from the munition 19 is asymptotic such that the curve goes from 0° when the projectile is directly over the target and approaches 90° when the projectile is about 20 to 50 meters away from the target, ignoring the length of the munition. At that point, as shown in FIG. 1A, it would be near linear (L2=L3) and L1 would come into play and be a minor contributor. Where sin Θ=L2/L3, Time=L2+L3 (ignoring the weapon length); L3=time/(sin Θ+1) and L2=sin Θ*L3.

In certain embodiments, the front and/or rear detectors are EO PIN diodes. In some cases, the forward looking detector is an RF antenna or an array PIN diode, or camera. The RF sensor has the advantage of being all weather, but the RF sensor has the disadvantage of large beams ~2-3° or larger depending on the application. In a UAS swarm environment RF provides large area coverage for a lower cost than electro-optical (EO) systems. EO systems using laser or narrow beam illuminators can direct the energy at longer distances to a specific target feature; a wall on a building, a door, a window, etc. The spatial control of some weapon systems may gravitate to an EO system for higher precision. In certain embodiments, the PIN array could be a standard commercial silicon or InGaAs detector. Depending on the wavelength and laser transmission power, an array may be supported by a 1 to 10 mm lens; dependent on the desired target detection range requirement.

Figure 2:
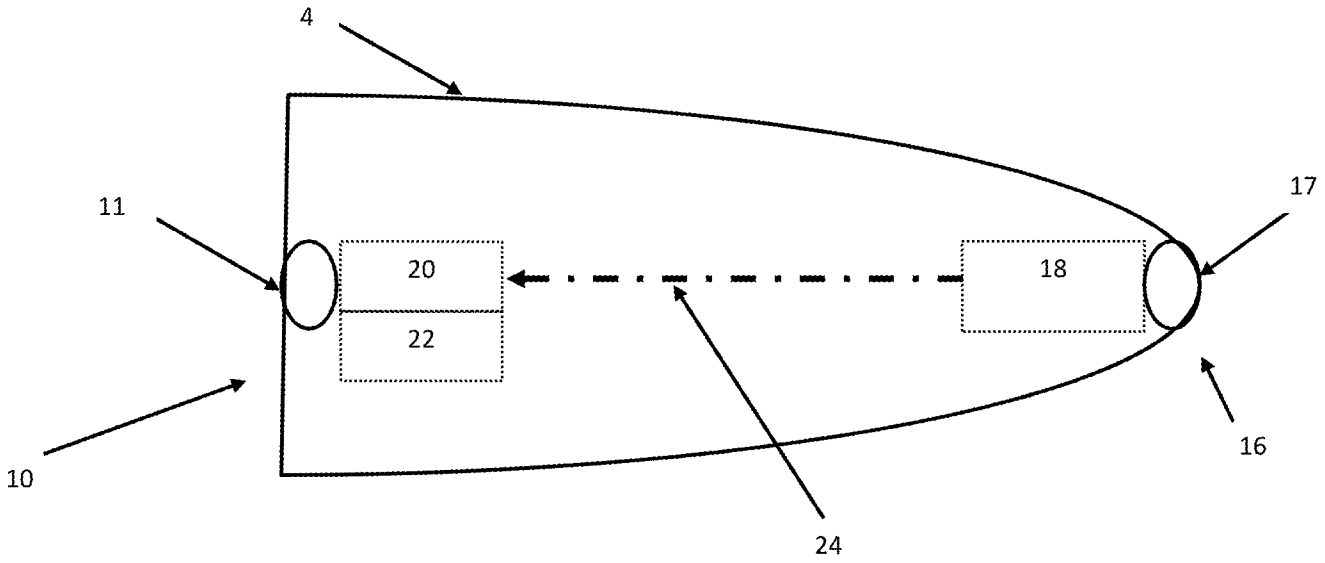
FIG. 2 illustrates two sensors with detector electronics and an associated processor on a munition according to the principles of the present disclosure.

Referring to FIG. 2, the construct of the two sensors located on the munition according to the principles of the present disclosure is shown. The munition could be a guided projectile from a .5 caliber sniper round to a 155 mm artillery shell. The guidance package could be spinning with respect to the ordnance or could be roll stabilized using a bearing between the ordnance the guidance package. In some cases, the time to measure can be accomplished by the elements shown in FIG. 2. More specifically, a front-facing detector 17, located about the front portion 16 may comprise an RF antenna, an EO with one or more lenses, an array PIN diode, a camera, or the like. In some cases, the rear-facing detector 11 located about the tail 10 may be one or more detectors, where the detector is an RF antenna, an EO with one or more lenses, or the like. In certain embodiments, the front detector electronics 18 is in communication 24 with the rear detector electronics 20 and a processor 22. In some cases, the communication link may be a cable, a magnetic inductance link, an RF link, an optical link, or the like.

Figure 3:
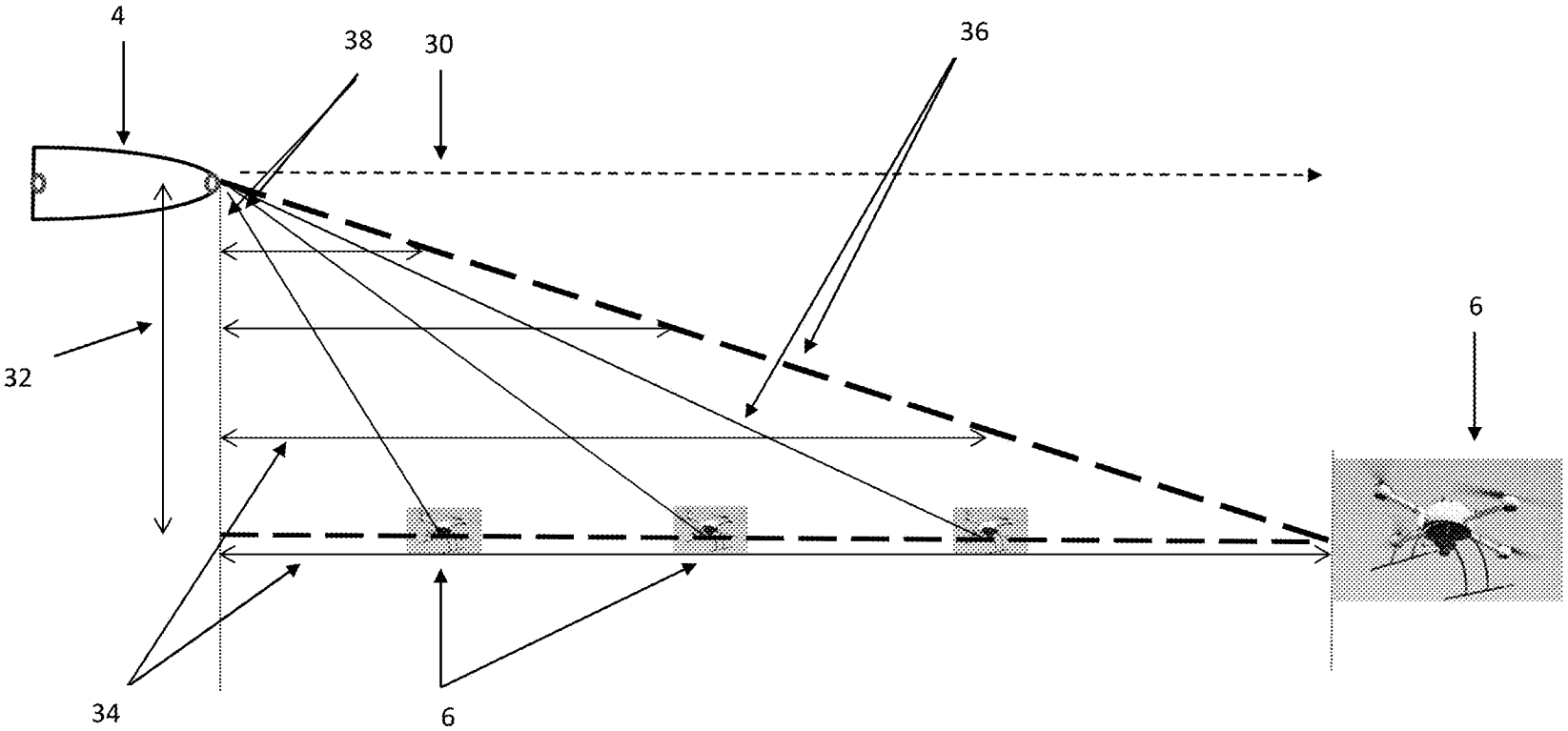
FIG. 3 illustrates the projectile's lateral offset and range to the target with corresponding theta (θ) according to one embodiment of the present disclosure.

Referring to FIG. 3, the projectile's lateral offset and range to the target with corresponding theta (θ) according to one embodiment of the present disclosure is shown. More specifically, FIG. 3 depicts the relationship between the cross range (i.e., a direction that is perpendicular to the direction of flight of the projectile) and the down range (i.e., the horizontal direction away from the launch site in the direction of travel of the projectile) between the projectile and the target. Depending on the projectile flight profile, warhead energetics, and the speed of a moving target (in all directions) there is an optimum angle, θ, which represents a detonation time. This diagram assumes the fragment pattern velocity is greater than the closing speed of the projectile and the target, or a "slow" velocity closing rate.

Still referring to FIG. 3, a munition 4 is fired and travels along a trajectory 30 towards a target 6. In this figure, a series of targets 6 are shown. There is a lateral offset distance 32 from the target(s). Each target has a range, or distance, 34 from the munition. Additionally, the projectile 4 has an actual offset angle 38, θ, relative to the target. In this figure, a slow velocity closing rate is depicted 36 using straight lines. This optimum warhead damage vector is dependent on weapon speed, warhead dispersion characteristics, and the like.

Figure 4:
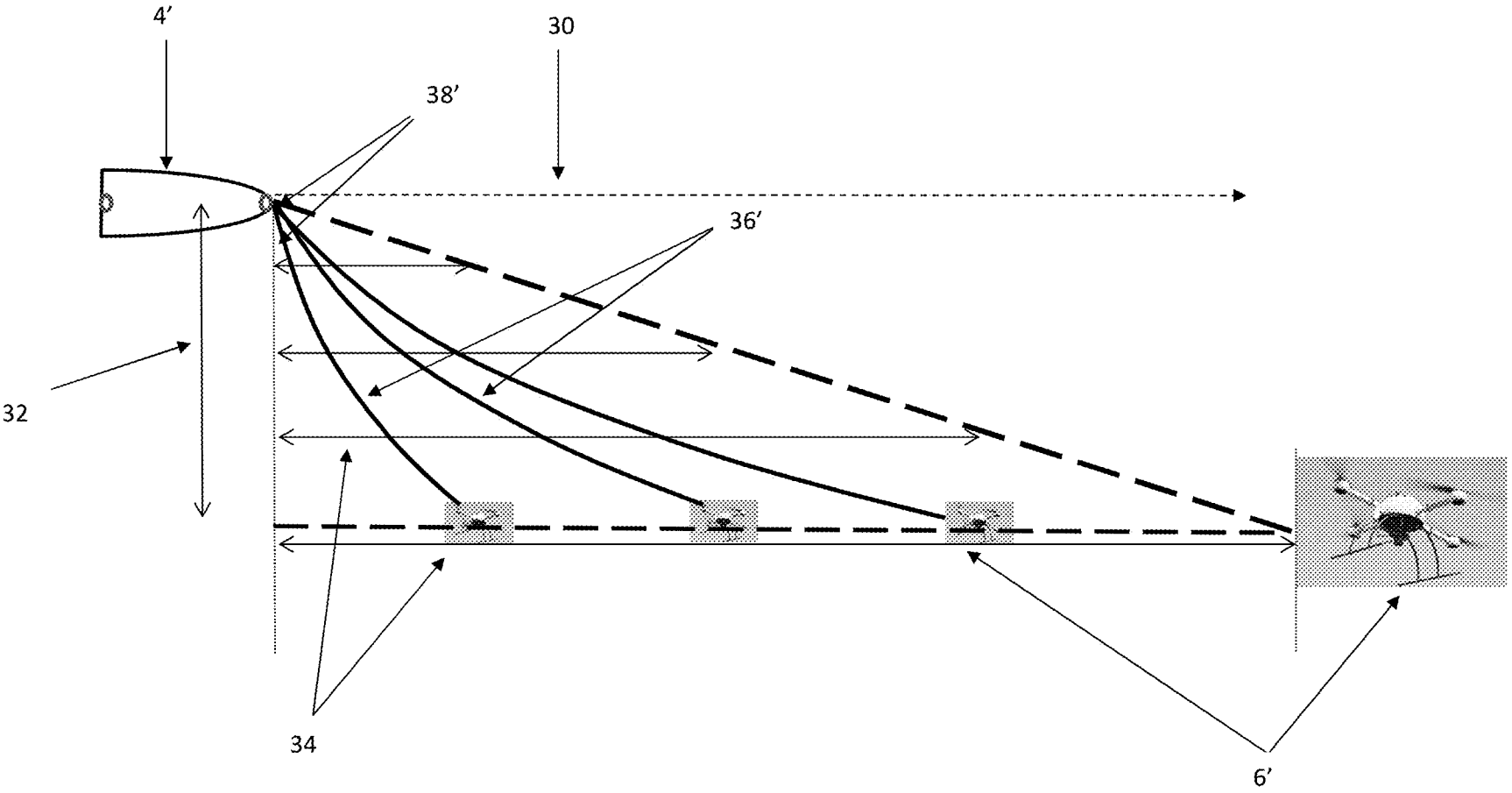
FIG. 4 illustrates the projectile's lateral offset and range to the target with corresponding theta (θ) and high velocity closing rate according to one embodiment of the present disclosure.

Referring to FIG. 4, the projectile's lateral offset and range to the target with corresponding theta (θ) and high velocity closing rate according to one embodiment of the present disclosure is shown. More specifically, FIG. 4 depicts the relationship between the cross range (i.e., a direction that is perpendicular to the direction of flight of the projectile) and the down range (i.e., the horizontal direction away from the launch site in the direction of travel of the projectile) between the projectile and the target. Depending on the projectile flight profile, warhead energetics, and the speed of a moving target (in all directions) there is an optimum angle, θ, which represents a detonation time. This diagram assumes a nonlinear relationship between fragmentation, aero impact on the fragmentation and the relationship between θ given a high velocity closing rate.

Still referring to FIG. 4, a munition 4' is fired and travels along a trajectory 30 towards a target 6'. In this figure, a series of targets are shown. There is a lateral offset distance 32 from the target(s). Each target has a range, or distance, 34 from the munition. Additionally, the projectile has an actual offset angle 38', θ, relative to the target. In this figure, a high velocity closing rate is depicted 36' using curved lines. This optimum warhead damage vector is dependent on weapon speed, warhead dispersion characteristics, and the like. In some embodiments, by utilizing range-to-go an estimated lateral offset can be determined due to the time delay over a series of pulse measurements.

Depending on the dispersion pattern of the warhead, the fragments are characterized in radial and forward motion and density. By arranging for the highest density pattern hitting the target, there is an optimum range/time-to-go for detonating the warhead. By the knowing the time/range-to-go, lateral displacement, and warhead fragment dispersion pattern, the plots in FIG. 3 and FIG. 4 can be generated thereby determining the θ, θ dot, and θ double dot firing threshold.

Figure 5:
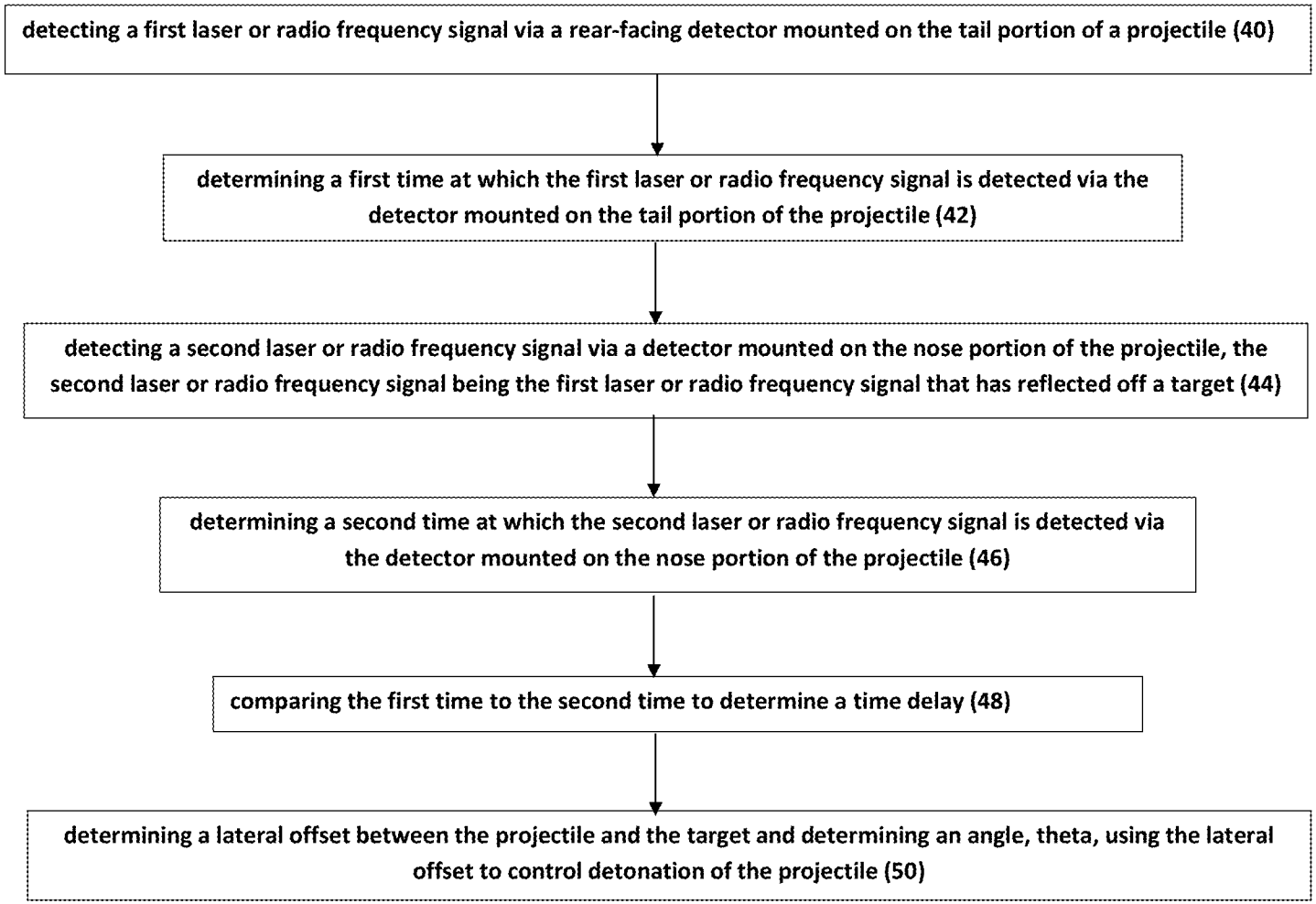
FIG. 5 shows a flowchart of a method according to one embodiment of the present disclosure.

Referring to FIG. 5, a flowchart of a method according to one embodiment of the present disclosure is shown. More specifically, the system detects a first laser or radio frequency signal via a rear-facing detector mounted on the tail portion of a projectile (40) and determines a first time at which the first laser or radio frequency signal is detected via the detector mounted on the tail portion of the projectile (42). The system detects a second laser or radio frequency signal via a detector mounted on the nose portion of the projectile, the second laser or radio frequency signal being the first laser or radio frequency signal that has reflected off a target (44) and determines a second time at which the second laser or radio frequency signal is detected via the detector mounted on the nose portion of the projectile (46). The system compares the first time and the second time to determine a time delay (48). Next, determining a lateral offset between the projectile and the target and determining an angle, theta, using the lateral offset to control detonation of the projectile (50).

While various embodiments of the present invention have been described in detail, it is apparent that various modifications and alterations of those embodiments will occur to and be readily apparent to those skilled in the art. However, it is to be expressly understood that such modifications and alterations are within the scope and spirit of the present invention, as set forth in the appended claims. Further, the invention(s) described herein is capable of other embodiments and of being practiced or of being carried out in various other related ways. In addition, it is to be understood that the phraseology and terminology used herein is for the purpose of description and should not be regarded as limiting. The use of "including," "comprising," or "having," and variations thereof herein, is meant to encompass the items listed thereafter and equivalents thereof as well as additional items while only the terms "consisting of" and "consisting only of" are to be construed in a limitative sense.

The foregoing description of the embodiments of the present disclosure has been presented for the purposes of illustration and description. It is not intended to be exhaustive or to limit the present disclosure to the precise form disclosed. Many modifications and variations are possible in light of this disclosure. It is intended that the scope of the present disclosure be limited not by this detailed description, but rather by the claims appended hereto.

A number of implementations have been described. Nevertheless, it will be understood that various modifications may be made without departing from the scope of the disclosure. Although operations are depicted in the drawings in a particular order, this should not be understood as requiring that such operations be performed in the particular order shown or in sequential order, or that all illustrated operations be performed, to achieve desirable results.

While the principles of the disclosure have been described herein, it is to be understood by those skilled in the art that this description is made only by way of example and not as a limitation as to the scope of the disclosure. Other embodiments are contemplated within the scope of the present disclosure in addition to the exemplary embodiments shown and described herein. Modifications and substitutions by one of ordinary skill in the art are considered to be within the scope of the present disclosure.

What is claimed:

1. A method for controlling detonation, comprising:

providing a projectile comprising a tail portion and a front portion;

detecting a laser signal via a tail detector mounted about the tail portion of the projectile;

determining a first time at which the laser signal is detected via the tail detector;

detecting a reflected laser signal via a front detector mounted on the front portion of the projectile, the reflected laser signal being the laser signal that has reflected off a target;

determining a second time at which the reflected laser signal is detected via the front detector;

comparing the first time to the second time to determine a time delay;

determining a lateral offset between the projectile and the target using the time delay; and determining an angle, theta, using the time delay to determine the detonation of the projectile, wherein the first signal further comprises a first pulse repetition interval and the second signal further comprises a second pulse repetition interval, and wherein the lateral offset between the projectile's trajectory and the target's actual position is determined by measuring a time expansion between the first pulse repetition interval and the second pulse repetition interval and convolving the projectile's velocity with the time-to-go thereby improving an accuracy of a detonation.

2. The method for controlling detonation according to claim 1, wherein the tail detector is an electro-optical PIN diode.

3. The method for controlling detonation according to claim 1, wherein the front detector is an array PIN diode.

4. The method for controlling detonation according to claim 1, wherein a range finding clock is started when the first signal is detected ($T_{zero}$) by the tail detector and the range finding clock is stopped when the reflected signal is detected by the front detector ($T_{reflected}$), thereby creating a time differential that represents a round trip time between the projectile and the target and converting to a range-to-go.

5. The method for controlling detonation according to claim 1, wherein when a detonation time-to-go is about 0.005 seconds, sending a signal to the projectile to cause the detonation.

6. The method for controlling detonation according to claim 5, wherein determining the time-to-go determination is dependent on the projectile speed and the detonation time-to-go is programmed at the time of launch.

7. The method for controlling detonation according to claim 5, wherein the time-to-go value is negative.

8. The method for controlling detonation according to claim 1, further comprising calculating theta-dot.

9. The method for controlling detonation according to claim 1, further comprising calculating theta double dot.

10. The method for controlling detonation according to claim 9, wherein taking a first derivative with respect to time minus angular velocity results in theta-dot or taking a second derivative with respect to time minus angular acceleration results in theta double dot, further comprising using theta-dot or theta double dot without the range-to-go calculation to determine the optimum detonating distance using a Kalman filter.

11. A method for controlling detonation, comprising:

providing a projectile comprising a tail portion and a front portion;

detecting a first RF signal via a tail detector mounted on the tail portion of the projectile;

determining a first time at which the first RF signal is detected via the tail detector;

detecting a reflected RF signal via a front detector mounted on the front portion of the projectile, the reflected RF signal being the first RF signal that has reflected off a target;

determining a second time at which the reflected RF signal is detected via the front detector;

comparing the first time to the second time to determine a time delay;

determining a lateral offset between the projectile and the target; and determining an angle, theta, using the time delay between detection by the tail detector and detection by the front detector to accurately control the detonation, wherein the first signal further comprises a first pulse repetition interval and the reflected signal further comprises a second pulse repetition interval, and wherein the lateral offset between the projectile's trajectory and the target's actual position is determined by measuring a time expansion between the first pulse repetition interval and the second pulse repetition interval and convolving the projectile's velocity with the time-to-go thereby improving an accuracy of a detonation.

12. The method for controlling detonation according to claim 11, wherein the detector on the tail and/or the nose of the projectile is a radio frequency antenna.

13. The method for controlling detonation according to claim 11, wherein a range finding clock is started when the first RF signal is detected ($T_{zero}$) by the tail detector and the range finding clock is stopped when the reflected signal is detected by the front detector ($T_{reflected}$), thereby creating a time differential that represents a round trip time between the projectile and the target, and converting to a range-to-go.

14. The method for controlling detonation according to claim 13, wherein when the time-to-go is time about 0.0015 seconds, sending a signal to cause the projectile to detonate.

15. The method for controlling detonation according to claim 13, wherein the time-to-go determination is dependent on the projectile speed and the detonation time-to-go is programed at the time of launch.

16. The method for controlling detonation according to claim 13, wherein the time-to-go value is negative.

17. The method for controlling a detonation according to claim 11, further comprising calculating theta-dot and/or theta double dot, wherein the theta dot is derived by taking a first derivative with respect to time minus angular velocity and theta double dot is derived by taking the second derivative with respect to time minus angular acceleration, and wherein the theta-dot and/or theta double dot is used without the range-to-go calculation to determine the optimum detonating distance using a Kalman filter.

18. A system for controlling detonation, the system comprising:

a projectile comprising a tail portion and a front portion, including a tail detector mounted proximate the tail portion and a front detector proximate the front portion; and a processor in communication with the projectile, the processor configured to:

detect a first RF signal via the tail detector;

determining a first time at which the first RF signal is detected via the tail detector;

detecting a reflected RF signal via the front detector, the reflected RF signal being the first RF signal that has reflected off a target;

determining a second time at which the reflected RF signal is detected via the front detector;

comparing the first time to the second time to determine a time delay;

determining a lateral offset between the projectile and the target; and determining an angle, theta, using the time delay between detection by the tail detector and detection by the front detector to accurately control the detonation, wherein the first signal further comprises a first pulse repetition interval and the reflected signal further comprises a second pulse repetition interval, and wherein the lateral offset between the projectile's trajectory and the target's actual position is determined by measuring a time expansion between the first pulse repetition interval and the second pulse repetition interval and convolving the projectile's velocity with the time-to-go thereby improving an accuracy of a detonation.

* * * * *